US005332642A

United States Patent [19]

Simms et al.

[11] Patent Number: 5,332,642

[45] Date of Patent: Jul. 26, 1994

[54] VACUUM ASSISTED DISPERSANT REDUCTION SYSTEM

[75] Inventors: Robert Simms, Downingtown, Pa.; Henry Till, E. Rochester, N.Y.; Robert K. Waring, Downington, Pa.; John Gardner, Penfield; Tab Tress, Henrietta, both of N.Y.; James Simpson, Reading, Pa.

[73] Assignee: Xerox Corporation, Stamford, Conn.

[21] Appl. No.: 17,453

[22] Filed: Feb. 12, 1993

Related U.S. Application Data

[63] Continuation of Ser. No. 779,556, Oct. 18, 1991, abandoned.

[51] Int. Cl.[5] ..... G03G 13/10; G03G 21/00

[52] U.S. Cl. ..... 430/125; 355/296; 355/307; 118/652; 101/425; 430/119

[58] Field of Search ..... 355/296, 307, 300, 298; 15/256.5, 256.51, 265.52, 308, 302; 118/652; 101/425; 430/125, 118, 117, 119

[56] References Cited

U.S. PATENT DOCUMENTS

| | | | |
|---|---|---|---|
| 3,453,681 | 7/1969 | Wiederhold | 15/306 |
| 3,669,073 | 6/1972 | Savit et al. | 118/637 |
| 3,757,398 | 9/1973 | Urban | 29/116 AD |
| 3,919,737 | 11/1975 | Riley, Jr. | 15/308 |
| 4,258,115 | 3/1981 | Magome et al. | 430/125 |
| 4,263,391 | 4/1981 | Saito et al. | 430/125 |
| 4,286,039 | 8/1981 | Landa et al. | 430/119 |
| 4,299,902 | 11/1981 | Soma et al. | 430/125 |
| 4,392,742 | 7/1983 | Landa | 355/15 |
| 4,607,947 | 8/1986 | Ensing et al. | 355/15 |
| 4,878,090 | 10/1989 | Lunde | 355/256 |
| 4,879,197 | 11/1989 | Kohmura et al. | 430/119 |
| 5,012,548 | 5/1991 | Jeffries | 15/308 |
| 5,023,665 | 6/1991 | Gundlach | 355/256 |
| 5,121,167 | 6/1992 | Gundlach | 355/296 |

*Primary Examiner*—Marion E. McCamish
*Assistant Examiner*—Rosemary Ashton
*Attorney, Agent, or Firm*—Oliff & Berridge

[57] ABSTRACT

In a device and method for increasing the solids content of an image formed from a liquid developer, absorption material is contacted with a toner dispersant laden image, and the absorbed dispersant is vacuumed out of the absorption material. The absorption material preferably is a conductive cover on a porous roller biased with an electrical charge which is the same as the charge of the toner particles, such that the resulting electric field repels the toner particles from the absorption material so that minimal toner particles are transferred to the absorption material.

26 Claims, 3 Drawing Sheets

VACUUM ASSISTED DISPERSANT REDUCTION SYSTEM

This is a continuation of application No. 07/779,556 filed Oct. 18, 1991, now abandoned.

FIELD OF THE INVENTION

The present invention relates to a device and method for increasing the solids content of an image formed from a liquid developer.

BACKGROUND

A typical electrostatographic printing machine (such as a photocopier, laser printer, facsimile machine or the like) employs an imaging member that is exposed to an image to be printed. Exposure of the imaging member records an electrostatic latent image on it corresponding to the informational areas contained within the image to be printed. The latent image is developed by bringing a developer material into contact therewith. The developed image recorded on the photoconductive member is transferred to a support material such as paper either directly or via an intermediate transport member. The developed image on the support material is generally subjected to heat and/or pressure to permanently fuse it thereto.

Two types of developer materials are typically employed in electrostatographic printing machines. One type of developer material is known as a dry developer material and comprises toner particles or carrier granules having toner particles adhering triboelectrically thereto. Another type of developer material is a liquid developer material comprising a liquid carrier or dispersant having toner particles dispersed therein.

When using a liquid developer material, excess liquid carrier such as Isopar (a non-polar decane solvent) frequently adheres to the photoconductive member and is transferred to the transport member (if any) and support material. This liquid carrier later evaporates into the air. Usually about 0.5 grams of liquid carrier is absorbed by a sheet of copy paper and carried out in each copy.

As the image is fused by heating the toner above its melting point and allowing it to flow into pores and/or surface irregularities of the support material, the heat required to fuse the image vaporizes a large percentage of the liquid carrier. It is desirable to remove the liquid carrier from the support material to minimize image show-through and to prevent problems associated with it emerging from the support material later. Additionally, increasing the solids content of an image before transferring it to an intermediate transport member greatly improves the ability of the toner particles to form a high resolution image on the transport member and thus on the support material.

The amount of liquid carrier in the tone image can be limited by a metering system. The most common metering technique is the reverse roll.

Reverse roll doctoring and corona doctoring reduce the amount of liquid carried out by the copy sheet from about 0.5 grams to about 0.12 grams per copy. Reverse roll doctoring provides superior background clean-up by having sufficient shear force to remove all the liquid carrier except the liquid carrier interstitially trapped in the toner image. However, very close spacing is required to do an effective job. It is particularly difficult to maintain this close spacing over large dimensions in applications such as color proofing master, and other graphic arts.

An air knife could also remove excess liquid carrier. However, the toner particles adhering to the latent image may also be removed, thereby disturbing the image.

Various techniques have been devised for removing excess liquid carrier from an imaging member.

U.S. Pat. No. 4,286,039 (Landa et al) discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 4,299,902 (Soma et al) discloses an image forming apparatus comprising an elastic roller which squeezes out and absorbs excess liquid developer. The elastic roller is comprised of a central roller, a porous elastic member wrapped around the roller, and an outermost elastic member with a plurality of penetrating pores.

U.S. Pat. No. 4,392,742 (Landa) discloses a cleaning system for a liquid developer electrophotographic copier comprising a roller formed with a resilient material, such as a closed-cell elastomer, having externally exposed, internally isolated surface cells. During an operation, the excess liquid on an imaging surface is absorbed by the cleaning roller. The cleaning roller is then compressed to squeeze out liquid from the roller, leaving the roller dry.

U.S. Pat. No. 4,878,090 (Lunde) discloses a development apparatus comprising a vacuum source which draws air around a shroud to remove excess liquid carrier from the development zone.

U.S. Pat. No. 4,879,197 (Kohmura et al.) discloses a pair of squeeze rollers for an electrophotographic machine comprising a metal roll with an elastomeric roller wrapped around the metal. The squeeze rollers remove excess developer from a photosensitive material.

U.S. Pat. No. 3,757,398 (Urban) discloses a squeezing roller comprised of a thin layer of synthetic material which squeezes liquid from textile webs.

U.S. Pat. No. 5,023,665 (Gundlach) discloses an excess liquid carrier removal apparatus for an electrophotographic machine. The apparatus is comprised of an electrically biased electrode having a slit therein coupled to a vacuum pump. The vacuum pump removes, through the slit in the electrode, liquid carrier from the space between the electrode and the photoconductive member. The electrical bias generates an electrical field so that the toner particle image remains undisturbed as the vacuum withdraws air and liquid carrier from the gap.

U.S. Pat. No. 4,607,947 (Ensing et al) discloses a circulating cleaning member comprising a multiplicity of spaced-apart openings or perforations. A surface of the cleaning member collects residues of toner from a surface to be cleaned.

SUMMARY OF THE INVENTION

The present invention enables higher processing speed, the use of simpler hardware and improved motion quality in an electrostatographic printing machine. A device and method of the invention increase the solids content of an image formed from a liquid developer. An absorption material is contacted with a toner dispersant laden image, and the absorbed dispersant is vacuumed out of the absorption material. The absorbent material is preferably disposed on a porous roller, and dispersant is vacuumed out of the absorption material from a central cavity of the porous roller. Additionally, the roller may be electrically conductive and biased with an electrical charge which is the same charge as that of the toner particles in the dispersant, such that a resulting electric field repels the toner particles from the absorption material so that minimal toner particles are transferred to the absorption material.

DETAILED DESCRIPTION OF PREFERRED EMBODIMENTS

In the invention, a vacuum absorption system is used to draw off liquid toner dispersant such as Isopar from an absorbent material which in turn is used to remove the dispersant from the toner image on a movable image carrying member such as an electrostatographic imaging member or intermediate transport member. By eliminating the excess dispersant while it is still liquid by vacuuming, less dispersant evaporates into the atmosphere, thus reducing pollution and potential health risks to individuals working near the machine. As the dispersant has a potential for being reused, it also makes the device more cost effective. In a preferred embodiment, the dispersant is removed by passing an absorbent material over a roller biased with the same charge as that of the toner. The bias repels the toner particles while allowing the dispersant to be absorbed. In an especially preferred embodiment, a conductive absorbent material is used with a biased roller. This allows the roller's electrical field to approach more closely to the toner image and thus exert a stronger repelling action than if the biased roller were separated from the toner image by an insulating absorbent material. In the case of a multi-layer medium, individual layers of it can be made conductive so that the overall thickness of the medium has little effect.

Figure 1:
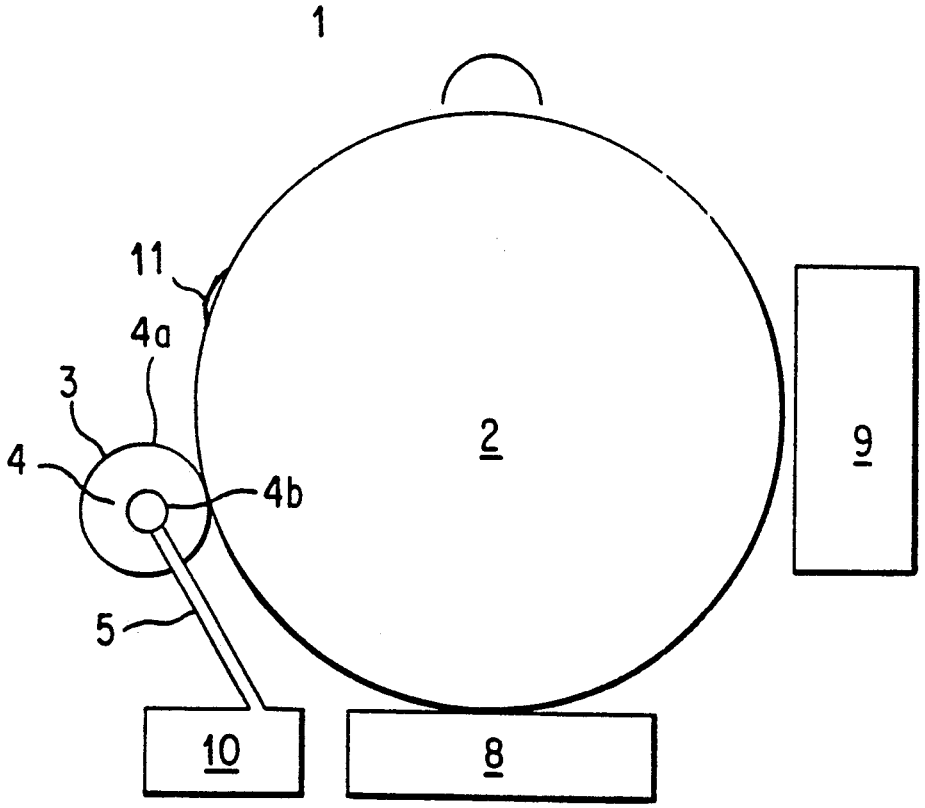
FIG. 1 is a schematic view of a portion of an electrophotographic printing machine incorporating an embodiment of the present invention therein.

FIG. 1 shows a vacuum absorption system of the invention wherein liquid dispersant is drawn from an imaging member 2. While a drum is shown in FIG. 1, the invention is equally useful with a belt-type imaging member. Suitable imaging members include known photoreceptors and ionographic receptors. The developer station 8 deposits toner and toner dispersant on a latent image on imaging member 2. The developed image rotates to the biased roller 3. Absorption material 4 covers and surrounds the biased roller 3. This absorption material 4, which contains small pores to absorb the toner dispersant, is brought into contact with the dispersant laden image. Capillary action and/or vacuum absorbs the dispersant in the absorption material. Adsorption material 4 has a first, outer contact surface 4*a* that contacts the toner dispersant laden image, and a second, inner surface 4*b*, opposite surface 4*a*, that is located closer to and contacts biased roller 3.

The absorption material may be any suitable material, preferably a foam such as one selected from the group consisting of Vyon ® (a high density microporous material), Permair ® (a microporous polyurethane material), Tetratex ® (a microporous semi-permeable membrane made of polytetrafluoroethylene) and "E" Foam (an absorbent elastomeric foam). Foams with a contact surface 4*a* that has an appearance of being glossy and non-porous though truly very porous are the greatest contributors to dispersant removal in the background areas, due to intimate contact with the image and to the fact that they cause the least amount of image loss or degradation. Top surface materials for good absorption and conformability characteristics should have on their surface some gloss in appearance and yet be very porous. The best surface characteristics have been found in materials that, due to "surface tension" are surface hydrophobic, yet readily absorb dispersant. The material must, of course, be compatible with whatever dispersant material is used.

Pore sizes of the absorbent material of about 0.2 to about 30 microns do very well, although one may use pore sizes outside these limits. Very small pores of a micron or less do an excellent job of absorbing the dispersant out of an image and off the background, though extracting the dispersant requires more vacuum pressure due to the increased capillary pressure. However, such a material could be used between an absorbing foam and the porous roller as a barrier to allow dispersant to absorb into the foam through the barrier but not allow it to rewet.

The volume porosity of a foam absorbent material is a parameter that must be taken into account when physical pressure is used to compact the image so as to avoid over compressing the foam pores and thus reducing or eliminating absorption from the image. Nominally at very low pressures the foam porosity can go as high as about 80% to about 95% and as low as about 5% to about 15%, whereas at high pressure the high figure could go down depending on the durometer and strength of the material.

The amount of toner removed from an image onto the surface of the absorption material relies in part on the surface texture of the absorption material. A greater surface texture allows for the imbedding of toner particles into the irregularities of the surface of the absorption material. Thus, a smoother glossy surface with small pores will allow fewer toner particles to become imbedded.

Additionally, the surface energy of the absorption material greatly influences the amount of toner removed from the image when there is little or no electric field compressing the image away from the absorption material. The material can be made of layers of materials, each possessing the necessary requirements of that layer.

The vacuum system 5 assists in drawing the toner dispersant from the absorption material and through the roller 3, which itself is porous and is preferably elastomeric. The vacuum system must be adjusted so as to remove only the dispersant and not have so strong a suction force so as to remove the toner. The vacuum pressure and the speed of the roller 3 may in one preferred embodiment be selected to keep the pores of roller 3 filled with dispersant. Pressure may be applied to the dispersant laden image by the roller 3, thereby reducing the pile height of the image 11 and increasing the amount of dispersant being absorbed.

The pores of the porous roller 3 may preferably range in size from about 0.05 microns to about 30 microns. The roller 3 is preferably biased with an electrical charge which is the same as the charge of the toner particles in the dispersant. The resulting electric field repels the toner particles from the absorption material 4 so that minimal toner particles are transferred to the absorption material 4. Preferably, the absorption material is electrically conductive so that the electric field may be stronger, closer to the toner image to enhance this repelling action.

At nominally low roller pressures with a field across the image, the percent solids of the image will go from about 10% after development to about 50% after vacuum absorption. With pressure applied to the bias roller compacting the image, this latter figure will continue to increase the percent solids of the image to about 70%. To accomplish this compression of image while absorption of the dispersant takes place, the compression strength of the absorbent material must be greater than the force on it, so that the interspatial voids or capillary paths within the absorption material are not eliminated or brought to saturation by constriction.

The dispersant is collected in collection box 10 which will allow for either disposal or recirculation of the dispersant. The imaging member 2 continues to rotate to the point where a transfer corotron 1 or another known mechanism transfers the toner image to an intermediate transport member such as a belt or directly to a support material such as paper. The imaging member 2 continues to rotate to cleaning station 9 where the image is erased and any remaining toner is removed. Another electrostatic image may then be formed on the rotating imaging member.

Figure 2:
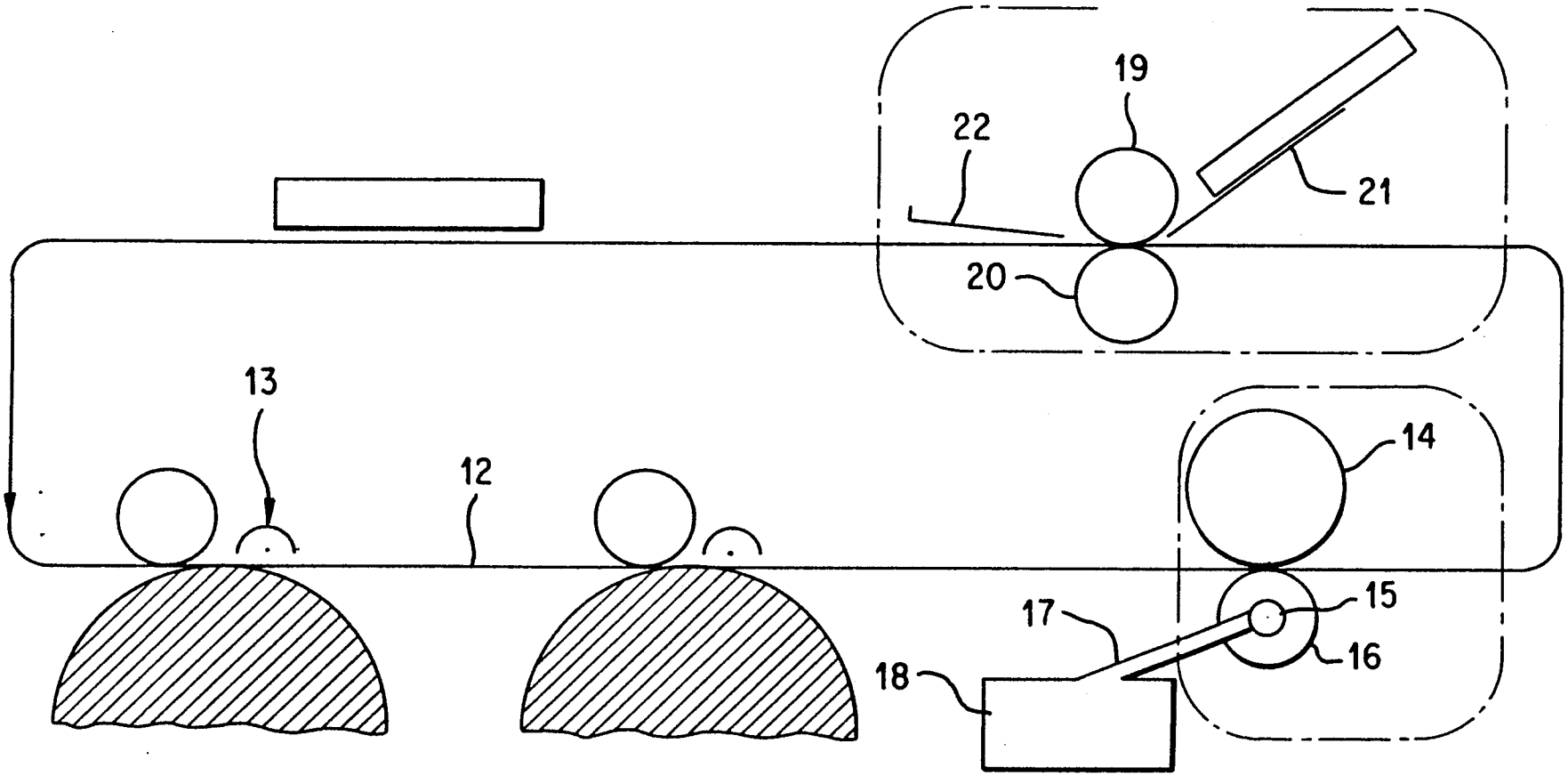
FIG. 2 is an enlarged schematic view of an embodiment of the invention whereby excess dispersant is removed from the toner image on an intermediate transport belt.

In the embodiment of FIG. 2, excess dispersant is removed from a toner image placed on intermediate transport belt 12, the toner image having been transferred from imaging members such as drums. A multicolor electrophotographic process is shown in which there are normally three or four drums with liquid toner images developed on them. For purposes of illustration only two drums are shown. Transfer corotron 13 transfers an image to the intermediate belt 12. The belt passes between a grounded roller 14 and the biased roller 15. This roller 15, which is covered by absorption material 16, simultaneously compresses the image on the intermediate belt 12 while absorbing and vacuuming away excess dispersant from the dispersant laden image on belt 12 by means of vacuum system 17. The excess dispersant is collected in dispersant collection box 18. The intermediate belt travels to a nip between a fuser roller 19 and a pressure roller 20 where it comes in contact with paper from a paper feeder 21. Under a temperature of about 250° F. the image is transferred from the intermediate belt to the paper, and the paper then exits and is collected in paper stacker 22.

Figure 3:
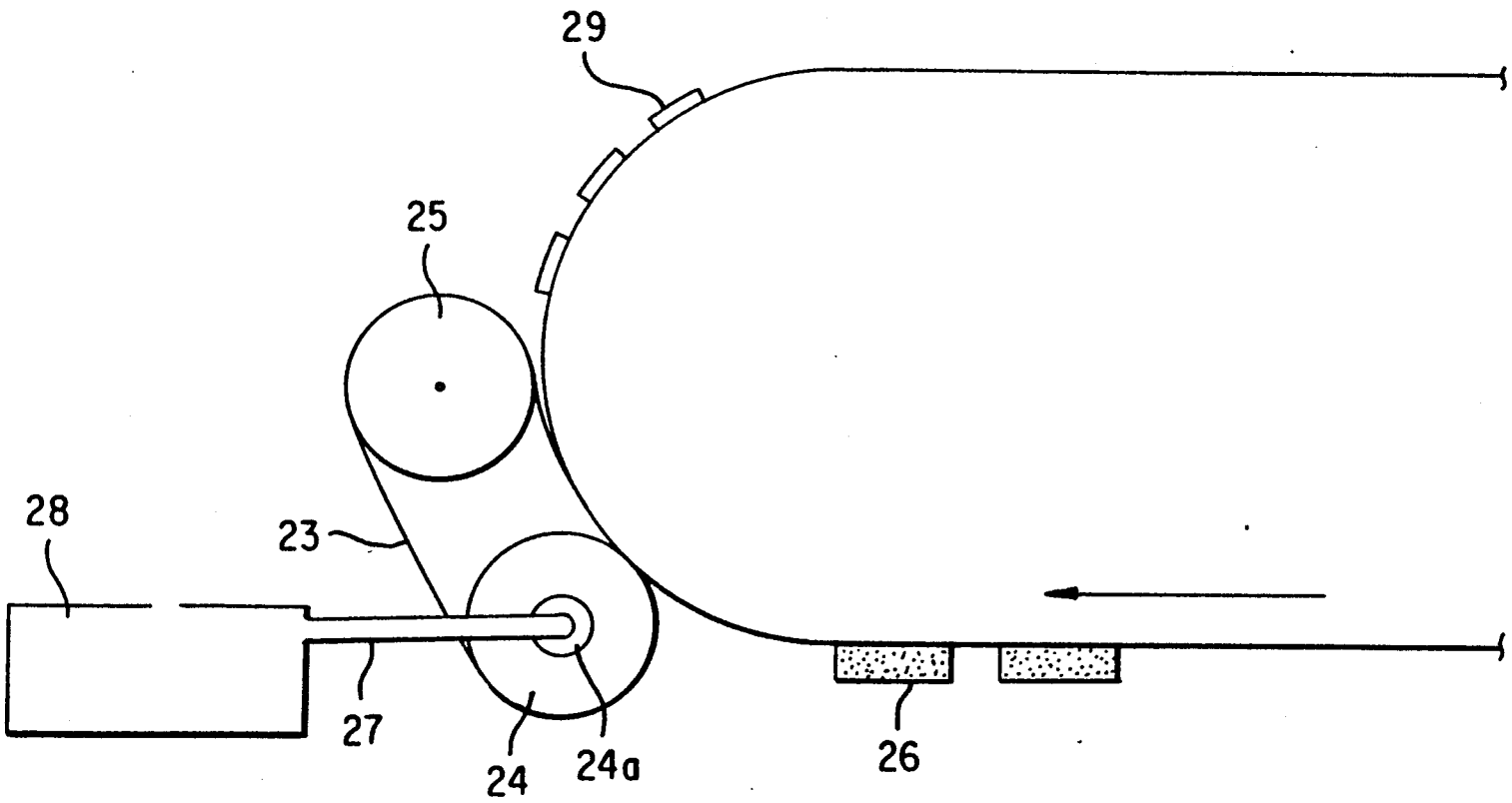
FIG. 3 is a schematic view of an embodiment of the invention wherein the absorbent material is positioned around a biased roller and an idler roller.

In the embodiment of FIG. 3, the absorption material forms a belt 23 which passes round the porous roller 24 and an idler roller 25. The entrance and exit angles of the belt can be adjusted by use of one or more idler rollers to reduce turbulence and disturbance of the toner image. The toner dispersant laden image 26 comes in contact with an absorption material belt 23 which absorbs the toner dispersant through capillary action. The porous roller 24 brings the absorption material belt 23 into contact with the dispersant laden image 26. Vacuum is provided through conduit 27 to remove excess toner dispersant from the absorption material belt 23 and from the roller 24. This dispersant is collected in collection box 28. Again, the roller is preferably biased with a voltage of the same sign as the toner particles, and the absorption material belt 23 is preferably conductive.

The amount of dispersant absorbed from the dispersant laden image 26 may be increased by applying a force to roller 24, thereby reducing the pile height of image 29.

The roller 24 is preferably hollow through its center (and thus roller 24 has a central cavity **24*a*) so that the vacuum system may be run completely through the roller for the most effective vacuuming process. In the embodiment of FIG. 3**, only part of the roller is in contact with the dispersant laden absorption material belt with the other part of the roller exposed. The suction efficiency of the vacuum may be maintained in this embodiment by selecting the vacuum to be less than the capillary pressure of the pores. Consequently, air is not sucked through the roller. A shield can also cover the back portion of the roller to avoid air flowing through the roller.

After the dispersant has been removed from a number of images, the outer surface of the absorption material may begin to have a finite layer of toner particles onto it. There are many possible ways to remove these toner particles such as a felt wiper positioned against the belt to scrub these particles off along with any other debris that may adhere to the belt.

Another method is to bias a dispersant squeeze roller of opposite polarity to that of the toner. The squeeze roller is placed against the absorption material. The toner from the absorption material thus deposits to the squeeze roller and may be wiped off with a urethane or similar blade.

It is, therefore, apparent that there has been provided in accordance with the present invention an apparatus and method for removing the liquid dispersant that fully satisfies the aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A method for removing toner dispersant from an image formed by depositing a liquid developer comprising toner and toner dispersant on a movable image carrying member of an electrostatographic printing system using a developer station, said toner dispersant being removed before said image is transferred to a receiving medium from said movable image carrying member by a transfer station, said method comprising:

contacting an outer, absorptive surface of an absorption material to said image on said image carrying member, so that said absorption material absorbs at least some of said toner dispersant from said image, said absorption material having an inner surface and being capable of passing absorbed toner dispersant therethrough from said outer surface to said inner surface, said absorption material located between the developer station and the transfer station of the electrostatographic printing system; and vacuuming absorbed dispersant through and out of the absorption material by applying a vacuum to the inner surface of said absorption material, a vacuum pressure of said vacuum being less than a capillary pressure of pores of the absorption material so that said absorption material remains filled with said dispersant and so that substantially no air is introduced into said pores by said vacuum during removal of said dispersant.

2. The method according to claim 1, wherein said absorption material covers a porous roller, with said inner surface of said absorption material, opposite from said outer surface, located closer to said roller than said outer surface.

3. The method according to claim 2, wherein the dispersant is vacuumed out of said absorption material from a central cavity of said roller.

4. The method according to claim 2, wherein said roller is comprised of an elastomeric material.

5. The method according to claim 2, wherein pores of said porous roller range in average diameter from about 0.05 microns to about 30 microns.

6. The method according to claim 2, further comprising biasing said roller with an electrical charge which is the same as an electrical charge of toner particles forming said image, such that a resulting electric field repels said toner particles from said absorption material.

7. The method according to claim 6, wherein said absorption material is electrically conductive.

8. The method according to claim 1, wherein said absorption material is comprised of a foam.

9. The method according to claim 8, wherein volume porosity of said foam ranges from about 5% to about 95%.

10. The method according to claim 1, wherein said absorption material comprises a belt passing around at least two rollers.

11. The method according to claim 1, further comprising forcing said absorption material against said image sufficiently to reduce a pile height of the image and increase the amount of dispersant being absorbed.

12. The method according to claim 1, wherein said absorption material pores range in average diameter from about 0.2 microns to about 30 microns.

13. The method according to claim 1, wherein a percent solids content of the image is increased from about 10% to greater than about 50%.

14. The method according to claim 1, wherein said movable image carrying member is an electrostatographic imaging member.

15. An electrostatographic printing system comprising:

a movable image carrying member;

a developer station for depositing a toner dispersant laden image on said image carrying member;

a transfer station for transferring said image formed on said imaging member to a receiving medium;

an absorption material, located between said developer station and said transfer station, capable of absorbing toner dispersant from the image formed on said image carrying member from a liquid developer, said absorption material having an outer surface in contact with said image carrying member and an inner surface, said absorption material capable of passing toner dispersant therethrough from said outer surface to said inner surface; and a vacuum source in fluid communication with said inner surface of said absorption material, said vacuum source applying a vacuum to said absorption material having a vacuum pressure less than a capillary pressure of pores of the absorption material so that said absorption material remains filled with said dispersant and so that substantially no air is introduced into said pores by said vacuum during removal of said dispersant.

16. The device according to claim 15, further comprising a porous roller, said absorption material covering said porous roller with said inner surface located closer to said roller than said outer surface.

17. The device according to claim 16, wherein said roller is biased with an electrical charge sufficient to repel electrically charged toner particles in said liquid developer.

18. The method according to claim 16, wherein said roller is comprised of an elastomeric material.

19. The device according to claim 16, wherein said porous roller includes a central cavity, and said vacuum source is in fluid communication with said central cavity of said porous roller, and is in fluid communication with said absorption material through pores in said porous roller.

20. The device according to claim 19, wherein said pores in said porous roller range in average diameter from about 0.5 microns to about 30 microns.

21. The device according to claim 15, wherein said absorption material is comprised of a foam.

22. The device according to claim 21, wherein volume porosity of said foam ranges from about 5% to about 95%.

23. The device according to claim 15, wherein said absorption material pores range in average diameter from about 0.2 microns to about 30 microns.

24. The system according to claim 15, wherein said image carrying member is a photoreceptor.

25. The system according to claim 15, wherein said image carrying member is an ionographic receptor.

26. The system according to claim 15, wherein said absorption material comprises a belt passing around at least two rollers.

* * * * *